US005570562A

United States Patent [19]

Anderson

[11] Patent Number: 5,570,562

[45] Date of Patent: Nov. 5, 1996

[54] MULTI-LANE EXTENDED PRODUCT TRANSFER FILLING MACHINE

[75] Inventor: Paul S. Anderson, Astoria, Oreg.

[73] Assignee: Carruthers Equipment Co., Warrenton, Oreg.

[21] Appl. No.: 445,770

[22] Filed: May 22, 1995

[51] Int. Cl.[6] ..... B65B 37/20; B65B 1/04

[52] U.S. Cl. ..... 53/250; 53/202; 53/252; 53/258; 53/514

[58] Field of Search ..... 53/252, 251, 250, 53/249, 539, 158, 534, 531, 546, 202, 514, 519, 518, 517, 516, 515, 258

[56] References Cited

U.S. PATENT DOCUMENTS

| | | | |
|---|---|---|---|
| 2,628,758 | 2/1953 | Gannon et al. | 53/517 X |
| 2,664,833 | 1/1954 | Armstrong et al. | 53/514 |
| 3,123,958 | 3/1964 | Carruthers | 53/517 |
| 3,179,041 | 4/1965 | Luthi | 53/517 X |
| 3,279,927 | 10/1966 | Reid | 53/514 X |
| 3,696,581 | 10/1972 | Eisenberg | 53/513 X |

*Primary Examiner*—James F. Coan
*Attorney, Agent, or Firm*—Robert L. Harrington

[57] ABSTRACT

A multi-lane extended product transfer filling machine for filling multiple lanes of containers simultaneously. The machine fills pockets with a sized portion at a product sizing station. The pockets are mounted to a chain which transfers the filled pockets from the product sizing station to a remote container filling station. Multiple tampers eject the food product from multiple filled pockets into multiple lanes of containers simultaneously. A programmable operating control unit controls the operation of the machine.

7 Claims, 3 Drawing Sheets

MULTI-LANE EXTENDED PRODUCT TRANSFER FILLING MACHINE

FIELD OF THE INVENTION

This invention relates to food product filling machines and more particularly relates to a filling machine that accommodates and fills multiple lanes of containers.

BACKGROUND INFORMATION

Container filling machines have been developed for inserting solid or semi-solid food products into containers. The food product is most often sliced into cube like portions to facilitate forming the food product into sized portions for ease of insertion of the food product into containers. The filling machine has a product sizing station where the food product is measured and sized into the desired portion to be inserted into a container. The sized portion is transferred from the sizing station to a container filling station where the sized food product portion is inserted into a container.

A machine of this type is disclosed in the commonly assigned application Ser. No. 08/164,138 now U.S. Pat. No. 5,401,156.

The sizing station of the machine inserts the desired portion into a movable pocket or turret insert. The machine transfers the pocket with the sized portion contained within from the sizing station to the filling station where a tamping cylinder or plunger dispenses or inserts the food product from the pocket into a container. The containers are transported by a single lane conveyor and are sequentially presented to the filling station. Machines of this type are arranged to fill only a single lane of containers.

There is a need for a machine that will fill multiple lanes of containers at the same time. The present invention fills that need.

BRIEF SUMMARY OF THE INVENTION

A preferred embodiment of the present invention is an extended product transfer filling machine arranged to insert sized portions of a food product into multiple lanes of containers simultaneously. The machine has multiple portion sizing stations where the food product is formed, sized and inserted into pockets of a pocket chain. The pocket chain functions as an extended product transfer mechanism to transfer the sized portions received in the pockets to a remote container filling station. The container filling station is arranged to dispense the food product from multiple pockets into multiple lanes of containers simultaneously.

DESCRIPTION OF THE PREFERRED EMBODIMENT

Figure 1:
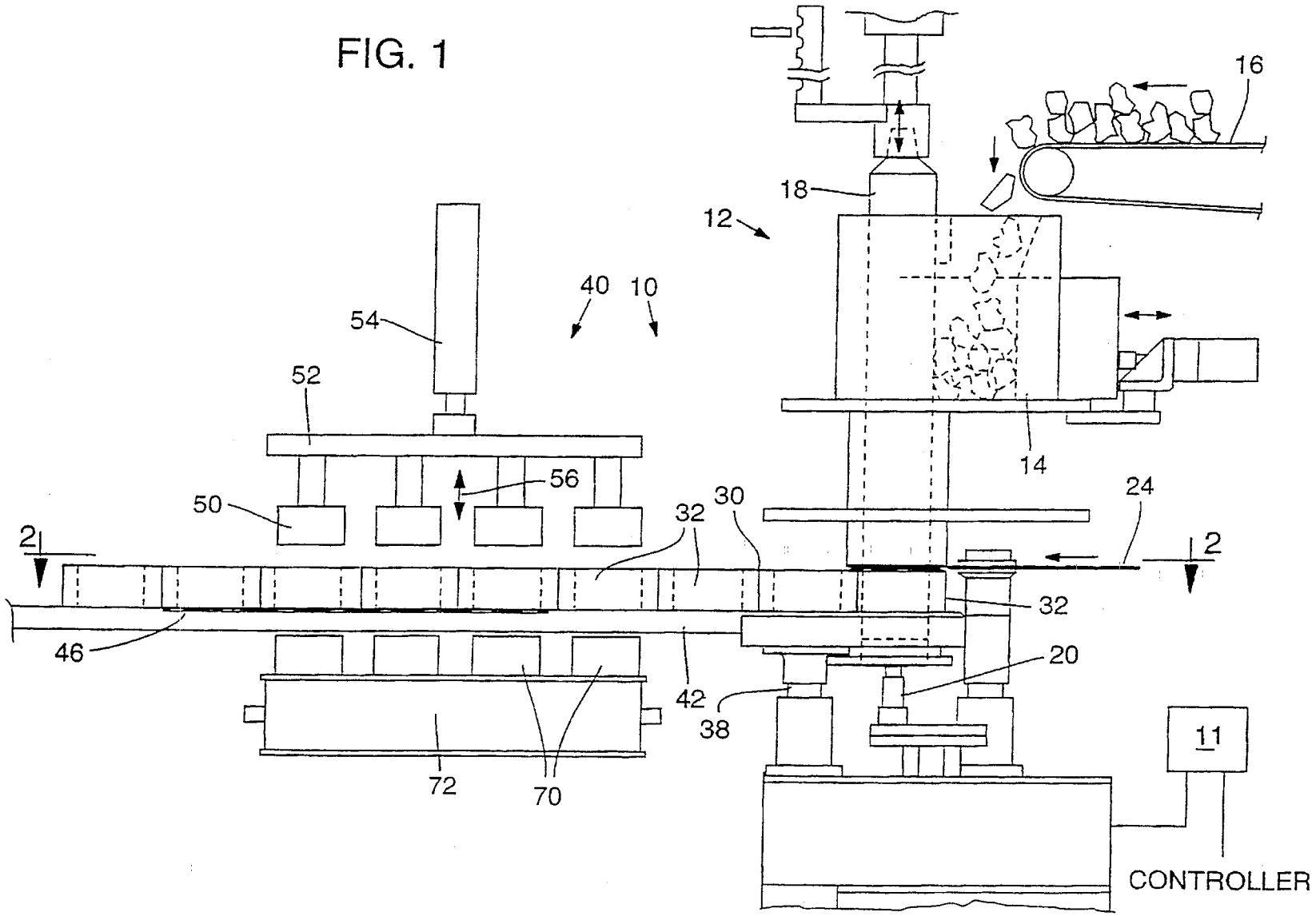
FIG. 1 is a view of the filling machine of the present invention.

Refer to FIG. 1 of the drawings which illustrates an extended product transfer filling machine 10 of the present invention. The machine 10 is arranged to size and compact determined portions of a food product into pockets, transfer the sized portions in the pockets to a remote filling station, and dispense the sized portions of multiple pockets into multiple lanes of containers simultaneously.

The machine 10 has a programmable operating control unit 11 to control the operation of the machine 10.

The machine 10 has a product sizing station 12 for sizing the food product into a determined portion. The sizing station has expandable forming chambers 14 to receive a quantity of the food product that is to be inserted into containers. The chambers 14 are expanded to receive the food product from an infeed conveyor 16 and are collapsed to form the food product into a column. An upper plunger 18 forces the formed column of food product into an open ended pocket 32 of a pocket chain 30. A lower plunger 20 operating in conjunction with the upper plunger 18 determines the size of the food product received in the pocket. The lower plunger 20 is arranged to enter the pocket 32 a distance to establish the height of the food product received in the pocket 32. The degree of compaction of the food product in the pocket 32 is controlled by a pressure switch. A rotatable knife 24 severs the food product received in the pocket 32 from the balance of the formed food product column. The pocket chain 30 is indexed to progressively transfer the filled pocket(s) 32 to the container filling station 40.

Figure 2:
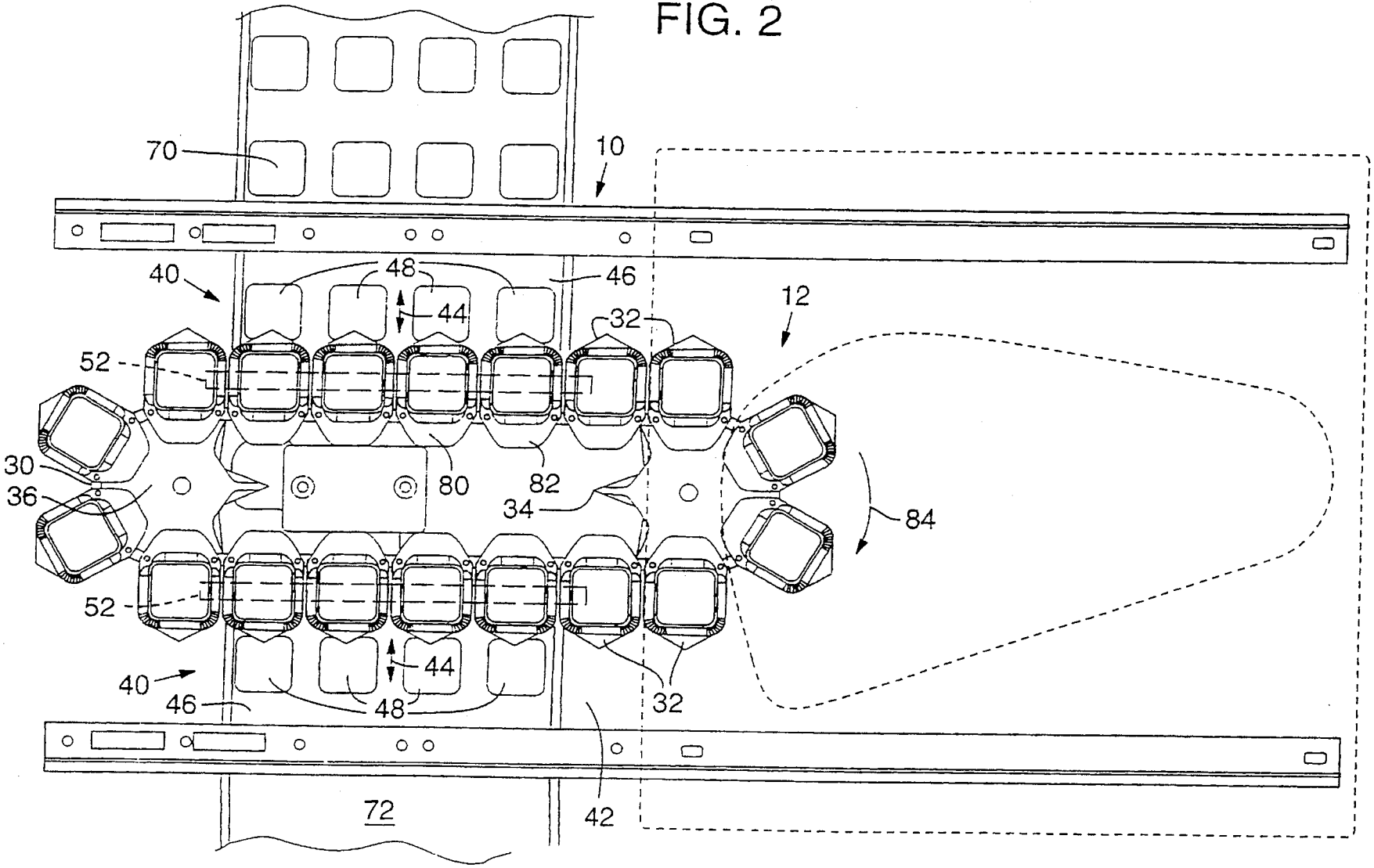
FIG. 2 is a view of the filling machine of FIG. 1 as viewed on view lines 2—2.

The pocket chain 30 is entrained around a drive sprocket 34 and an idler sprocket 36 as best seen in FIG. 2. The drive sprocket 34 is mounted to and is driven by a turret shaft 38 (see FIG. 1) of the machine 10. The pockets 32 are mounted to the pocket chain 30 which moves the pockets 32 in sequence from the pocket filling station 12 to the remote container filling station 40. The pockets 32 of the chain 30 are supported by and travel on a guide plate 42 which in effect provides a bottom for the open ended pockets 32 as the pockets 32 are moved from the sizing station 12 to the remote filling station 40.

The filling station 40 has tamper plungers 50 mounted to a common bar 52. The bar 52 and the tamper plungers 50 are movable upwardly and downwardly by a cylinder 54 as indicated by arrow 56. The cylinder 54 will move the tamper plungers 50 downward into the pockets 32 that are positioned below the plungers 50 during the container fill cycle. The tamper plungers 50 will eject the food portion received in the pockets 32 into the containers 70 that are transported by the conveyor 72.

The guide plate 42 has a slide plate 46 that is movable substantially transverse to the direction of travel of the pocket chain 30 as indicated by arrow 44. The slide plate 46 has openings 48. The slide plate 46 is positioned strategic to the filling station 40 and is movable to position its openings 48 directly under the pockets 32 from which the food is to be dispensed into containers 70. The slide plates 46 (on each side of the machine 10) are shown in FIG. 2 with the openings 48 out of the travel path of the pockets 32 of the chain 30. The movement of the slide plate 46 is coordinated with the container filling cycle of the machine 10. When the pocket chain 30 has been advanced to present the required number of pockets 32 containing a sized portion to the container filling station 40, the slide plate 46 is moved by a known actuator to position the openings 48 of the slide plate under the pockets 32 from which the food product is to be dispensed. The slide plate movement is coordinated with the determined cycle of the machine 10 and in particular the dispensing of the food products in the pockets by the tamping plungers.

As previously mentioned, the machine 10 has tamping plungers 50 at the filling station 40 which are arranged to descend down into the pockets 32 to dispense the food product from the pockets 32 and into the containers 70. The tamper plungers 50 are movable upwardly and downwardly by a motor such as a cylinder 54. In this embodiment, tamping plungers 50 are provided on each side of the machine and are positioned strategic to the pocket chain 30. Only the dashed outline of the two bars 52 on which the tamper plungers 50 are mounted are shown in FIG. 2 to show the position of the two sets of plungers 50.

The machine 10 is arranged to fill multiple lanes of containers 70 simultaneously. A multiple lane conveyor 72 conveys multiple lines of containers 70 to the filling station 40 of the machine 10. The indexing of the multiple lane conveyor 72 is coordinated with the sizing station cycle, the indexing of the pocket chain and the container filling cycle to advance the empty containers 70 to the filling position.

In this embodiment, the sizing station 12 fills two pockets 32 at a time and thus when two pockets 32 have been filled, the pocket chain 30 is advanced two pockets. The next two pockets 32 are filled and the pocket chain 30 is again advanced two pockets. This cycle is repeated until the number of filled pockets 32 required for filling the containers 70 on the multiple lane conveyor 72 is met.

In this embodiment, the sizing station 12 fills two pockets 32 at a time and the dispensing station 40 is arranged to dispense the product received in eight pockets 32 into eight containers 70 simultaneously. The sizing station 12 fills two pockets 32 with food product and then the pocket chain 30 advances two pockets as indicated by arrow 84. This cycle is repeated until the first pair of pockets filled are at positions indicated by numerals 80 and 82 as shown in FIG. 2. Containers 70 are moved by the conveyor 72 to position the containers 70 under the pockets 32 from which the food product is to be dispensed. The slide plates 46 on both sides of the chain are then moved to position an opening 48 directly beneath each of the pockets 32 from which the food product is to be dispensed into the containers 70. The eight tamper plungers 50 descend into the pockets 32 to eject the food product out of the pockets 32 and into the containers 70 below. The tamper plungers 50 are then retracted out of the pockets 32. When the pockets 32 under the tamper plungers 50 have been emptied, the slide plates 46 are moved to position the openings 48 out of the travel path of the pockets 32. The sizing station 12 during the dispensing of the food product from the pockets 32 into the containers 70 fills two pockets 32. At the completion of the dispensing (container filling) cycle and the filling of the two pockets 32, the pocket chain 30 is advanced two pockets. The conveyor 72 is advanced at the completion of the dispensing cycle to position the next containers 70 in position to be filled. The sizing cycle is repeated until four pockets 32 have been filled which places the first pocket 32 that has a food product in it at the position indicated by numeral 82. The slide plates 46 are again moved to position the openings 48 under each of the pockets 32 at the container filling station 40 to facilitate dispensing the portion in the pockets 32 into the containers that have been positioned below the pockets 32 by the multi-lane conveyor 72. The plungers 50 descend into the pockets 32 to dispense the food product from the pockets 32 into the containers 70.

The next cycle requires the filling of twelve pockets 32 with the sized portions to place the first pocket with food product in it at position 82 as shown in FIG. 2. The dispensing cycle is actuated and the process is started over again.

Figure 3:
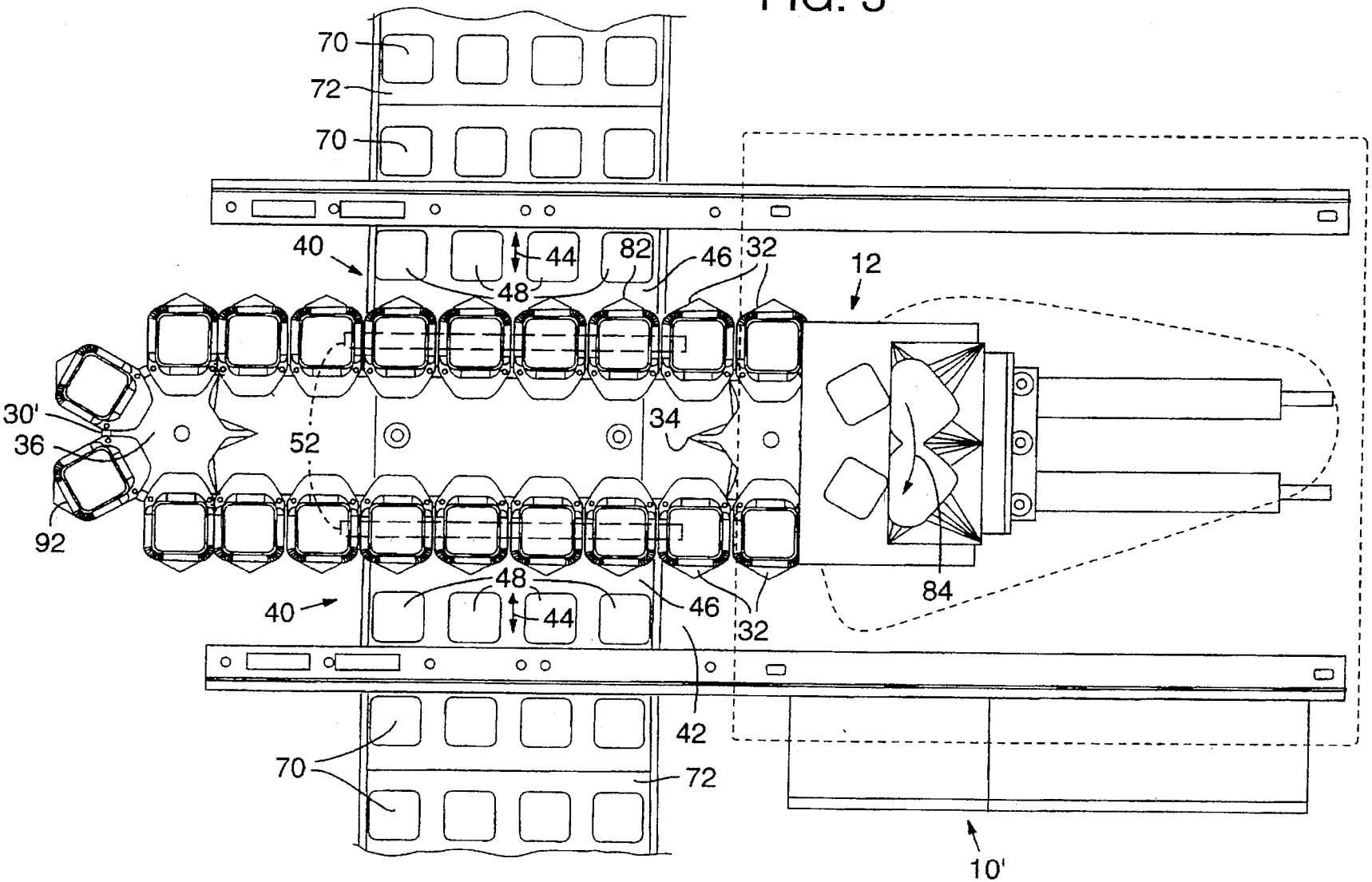
FIG. 3 is a view similar to FIG. 2 illustrating another embodiment of a filling machine of the present invention.

FIG. 3 illustrates another embodiment of a filling machine 10' of the present invention.

The machine 10' is arranged in a similar manner as the machine 10 of FIGS. 1 and 2. The machine 10' has a product sizing station 12, a pocket chain 30', and a container filling station 40. the product sizing station 12 will insert a sized portion into two pockets at a time and the container filling station 40 will dispense the product from eight pockets 32 into eight containers at a time.

The machine 10' in this embodiment has twenty-two pockets 32 on the chain 30'. This arrangement provides for uniform indexing of the pocket chains during a container filling cycle.

At the start of a cycle, the machine 10' fills two pockets 32 and the chain 30' is indexed to advance two pockets 32 in the direction indicated by arrow 84.

The cycle of filling two pockets 32 and advancing the chain 30' two pockets continues until the first pocket 32 with food product in it is at position 92. As shown, four pockets 32 with food product in them have advanced beyond the container filling station 40 on one side of the machine 10'. The pockets 32 at the container filling station on the other side of the machine are empty.

The container filling cycle is initiated and all of the tamper plungers 50 descend into the pockets 32 at the container filling station 40. Since there are only four pockets 32 with food product in them on one side of the container filling station 40, only product from four pockets 32 is dispensed into containers 70.

The machine 10' then continues the cycle of filling two pockets and advancing the chain two pockets until eight additional pockets 32 have been filled. This will advance the pocket 32 that was at position 92 to the position indicated by numeral 82.

There are now eight pockets 32 with food product in them at the container filling station 40 (four pockets on each side of the machine). The product in the eight pockets 32 is dispensed into eight containers 70 as previously described in reference to the machine 10 of FIGS. 1 and 2.

The cycle of filling and advancing eight pockets and dispensing the food product from eight pockets 32 into eight containers 70 continues until the last containers to be filled is determined.

It will be appreciated that other starting cycles may be implemented. At start up, for example, the machine 10' may be arranged to fill two pockets 32 and advance the chain 30' two pockets 32 until four pockets are filled. The chain 30' is then skip indexed so that the next four pockets 32 are empty. The machine then continues to fill two pockets 32 and index the chain 30' two pockets until the first pocket 32 with food product in it is a position 82. This will position eight pockets 32 with food product in them at the container filling station 40. The product in the eight pockets 32 at the filling station 40 is then dispensed into eight containers 70. The machine 10' then continues to fill and advance eight pockets and dispense the product from eight pockets 32 into eight containers 70 until the last containers to be filled is determined.

It will be appreciated that the number of pockets 32 that are to be emptied into the containers 70 may be varied to suit the requirements. In this embodiment, tamping plungers 50 are provided on the out feed portion and the return portion of the pocket chain. The tamping plungers may be provided on one side of the chain only and the number of tamping plungers may be varied to suit.

The arrangement of the machine 10 may be varied to suit the requirements of the user. The machine 10 in a preferred embodiment is arranged to fill two pockets at a time, however the number may be varied by changing the number of the sizing units on the machine. The number of pockets in the pocket chain may also be varied to suit the requirements. Additionally the number of containers that are filled simultaneously may be varied by changing the number of tamping plungers at the dispensing station 40. The cyclical operation of the machine 10 is altered to suit the parameters set for the machine such as the number of pockets filled at a time, the number of pockets in the pocket chain, the number containers filled at one time and so forth.

It will be apparent to those skilled in the art that other variations and modifications may be made without departing from the true spirit and scope of the invention. The invention is therefore not to be limited to the embodiments described and illustrated but is to be determined from the appended claims.

What is claimed is:

1. In combination with an automatic filling machine for inserting a sized portion of a food product into a container, an extended product transfer mechanism for transferring a sized portion from a food product sizing station to a remote container filling station, comprising:

a plurality of open ended pockets arranged sequentially to receive a sized portion of a food product at the food product sizing station;

a remote container filling station having multiple filling positions for receiving multiple containers in a determined side-by-side arrangement;

a transfer mechanism for transferring the sequentially arranged pockets from the food product sizing station to said remote container filling station, the transfer mechanism arranged to position a multiple of said pockets at the determined side-by-side arrangement of containers at the filling positions and to insert the sized portion of food product from said multiple pockets into said multiple containers at the container filling station simultaneously.

2. In combination with an automatic filling machine for inserting a sized portion of a food product into a container, an extended product transfer mechanism for transferring a sized portion from a food product sizing station to a container filling station as defined in claim 1, wherein:

the transfer mechanism includes a chain, the open ended pockets mounted to the chain.

3. In combination with an automatic filling machine for inserting a sized portion of a food product into a container, an extended product transfer mechanism for transferring a sized portion from a food product sizing station to a remote container filling station comprising:

open ended pockets arranged to receive a sized portion of a food product at the food product sizing station;

a transfer mechanism including a chain connected to said pockets for transferring the pockets from the food product sizing station to a remote container filling station, the transfer mechanism arranged to insert the sized portion of food product from multiple pockets into multiple lanes of containers at the container filling station simultaneously; and a guide plate; the open ended pockets and the chain travel on the guide plate and the guide plate serves as a bottom for the open end pockets.

4. In combination with an automatic filling machine for inserting a sized portion of a food product into a container, an extended product transfer mechanism for transferring a sized portion from a food product sizing station to a container filling station as defined in claim 3, wherein:

a slide plate having openings therein is mounted to the guide plate, the slide plate movable to position the openings into and out of the travel path of the open ended pockets.

5. In combination with an automatic filling machine for inserting a sized portion of a food product into a container, an extended product transfer mechanism for transferring a sized portion from a food product sizing station to a container filling station as defined in claim 4, wherein:

the transfer mechanism includes multiple tampers at the remote container filling station, the tampers movable into and out of multiple open ended pockets to eject the sized portions from the pockets into multiple lanes of containers.

6. In combination with an automatic filling machine for inserting a sized portion of a food product into a container, an extended product transfer mechanism for transferring a sized portion from a food product sizing station to a container filling station as defined in claim 5, further including:

a programmable operating control unit, the programmable operating control unit controlling the operations of the machine.

7. A system for simultaneously filling multiple containers with food product from a food product sizing machine comprising:

an elongate carrier defining an oval-like path having opposed ends and sides, a continuous sequence of food product pockets carried by said carrier in the oval-like path whereby a pocket is positioned at one end of the carrier and multiple pockets are positioned along each side, and a control for controlling the advancement of said carrier and the positioning of the pockets along a side of said path;

a food product sizing machine at said one end of the carrier sequentially filling the pockets with a sized portion of food product;

a conveyor and rows of side-by-side containers arranged in columns carried by said conveyor, said conveyor defining a path that passes under and transverse to the elongate path of the pockets, said conveyor and carrier in combination configured to position sequentially the side-by-side containers under a similar number of pockets along a side of the path of the carrier and in vertical alignment therewith; and a-mechanism for transferring food product from the pockets to the containers when aligned under the pockets.

* * * * *